US008066035B1

(12) United States Patent
Stevens

(10) Patent No.: US 8,066,035 B1
(45) Date of Patent: Nov. 29, 2011

(54) BEAD STRINGING APPARATUS FOR FASTER BEADING OF ORIGINAL DESIGNS

(75) Inventor: Denise Marie Stevens, Malibu, CA (US)

(73) Assignee: Denise M. Stevens, Malibu, CA (US)

( * ) Notice: Subject to any disclaimer, the term of this patent is extended or adjusted under 35 U.S.C. 154(b) by 0 days.

(21) Appl. No.: 11/811,960

(22) Filed: Jun. 12, 2007

Related U.S. Application Data

(60) Provisional application No. 60/813,258, filed on Jun. 12, 2006.

(51) Int. Cl.
*D03D 29/00* (2006.01)
*A41H 43/00* (2006.01)
*D03D 41/00* (2006.01)

(52) U.S. Cl. ..... 139/29; 139/30; 139/31; 139/32; 139/33.5; 139/34; 223/48

(58) Field of Classification Search ..... 139/29–33, 139/33.5, 34; 223/48, 102–104, 109 R, 117, 223/118, 123, 124
See application file for complete search history.

(56) References Cited

U.S. PATENT DOCUMENTS

| | | | | | |
|---|---|---|---|---|---|
| 737,073 | A * | 8/1903 | Bush | 28/151 |
| 2,504,940 | A * | 4/1950 | Wallach | 28/151 |
| 2,802,255 | A * | 8/1957 | Wallach | 28/151 |
| 3,196,064 | A | 7/1965 | Tell | |
| 3,284,882 | A | 11/1966 | Marchesan | |
| 3,545,069 | A | 12/1970 | Krieger | |
| 3,708,862 | A * | 1/1973 | Powell, Jr. | 29/433 |
| 4,280,266 | A | 7/1981 | Tomita et al. | |
| 4,785,521 | A | 11/1988 | Ho | |
| 5,197,175 | A | 3/1993 | Yuen | |
| 5,592,835 | A * | 1/1997 | Herr | 63/4 |
| 6,719,013 | B1 * | 4/2004 | D'Estais | 139/29 |
| 6,729,508 | B1 | 5/2004 | Klimpert et al. | |
| 7,147,008 | B2 | 12/2006 | Sayler | |

* cited by examiner

*Primary Examiner* — Bobby Muromoto, Jr.

(57) ABSTRACT

A bead stringing apparatus that enables the user to quickly restring pre-strung beads, of the type that are on temporary strings, commonly available in bead stores. The connectors on the apparatus pull both ends of the temporary string in a taut position over an open work space. This aligns the pre-strung beads automatically along the temporary string allowing them to be restrung easily by a permanent string or wire. The user can quickly resting rows of the pre-strung beads by putting their wire through the aligned holes and when the wire exits a row of the pre-strung beads the user can add in other loose beads on their wire to go in and between the pre-strung beads. This allows the user to create infinite designs and patterns of beadwork. The open work space around the pre-strung beads provides flexibility and ample room for the newly incorporated loose beads to hang down onto the permanent wire out of the way of the beading process. The pre-strung beads can also be measured along the temporary string for bead patterning.

1 Claim, 5 Drawing Sheets

BEAD STRINGING APPARATUS FOR FASTER BEADING OF ORIGINAL DESIGNS

CROSS REFERENCE TO RELATED APPLICATIONS

Provisional patent 112,948 U.S. PTO 60/813,258 filed Jun. 12, 2006

FEDERALLY SPONSERED RESEARCH

Not Applicable

JOINT RESEARCH AGREEMENT

Not Applicable

BACKGROUND OF THE INVENTION

This invention relates to bead stringing, more specifically an apparatus to aid in faster beading while allowing the user to create original beaded patterns and designs.

DESCRIPTION OF RELATED ART

When stringing beads by hand it is a timely process. There have been many machines and devices invented to string beads mechanically. However these machines and devices are useless to users who want to make their own designs and patterns in the beading process. Rotating bead stringing apparatus U.S. Pat. No. 5,197,175 Yuen 1992, this device rotates beads in a chamber and a random collection of beads will end up on the users wire or needle. This device does now allow the user to create their own beading patterns because the beads are collected randomly by the rotation process. Automatic bead threading toy U.S. Pat. No. 4,280,266 Tomita 1981, and method for automatically linking beads U.S. Pat. No. 4,785,521 Ho 1988, and Mechanical beading system U.S. Pat. No. 6,729,508 Klimpert 2004, these are all mechanical beading devices, therefore leaving out creative input by the user in their beading designs. Another invention Method and means for restringing beads U.S. Pat. No. 3,545,069 Krieger 1970 is a device that was made for the purpose of restringing beads manually. However it is made only to restring the beads already pre-arranged on a temporary string, the type of beads commonly found on temporary strings in bead stores. This device does not allow the user ample room to incorporate other loose beads into their beading designs and inhibits any creative input for original beading designs and patterns. This device suspends the pre-strung beads across a planar or rigid flat surface to hold the beads in an upward position forcing the temporary string down to create a space for the wire to be threaded through the row of beads without interfering with the temporary string. This method of strapping the beads onto a flat surface leaves the strand of beads rigid and inflexible making it hard to work with. Also the user's hands would be so close to the planar surface pushing down against it making it awkward to get the wire through the hole easily. It also would make it impossible for the user to incorporate other loose beads into their work, especially odd shaped and larger beads would be difficult to incorporate because there would be no space for the added beads to go, the extra beads would bulge out and get in the way making it impossible to continue along the beading surface. The embodiment of this invention in which the beads are suspended by hooks, the planar surface is above the beads and would also get in the way of the beading process. When the user goes to restring the beads, the temporary string would move upward and dislodge, therefore this embodiment is logistically impossible. Each embodiment of this invention has an element that gets in the way of the beading process, either below or above the beads, thus making this device very awkward to use. This device is made only for the purpose of re-string the beads that are already prearranged onto the temporary string, therefore not allowing the user to create new and original patterns and designs limiting its use. There are other devices that are used for bead looming such as U.S. Pat. No. 7,147,008 Sayler 2006, a String bead loom, however these bead loom devices are used for a different purpose of suspending empty strings to weave beads into after the beads are re-strung individually, which is a tedious process. Accordingly, all of the devices suffer from a number of disadvantages:

a. The bead stringing devices thus far only allow for the user to string a random collection of beads or re-string beads already pre-arranged on a temporary string leaving out the incorporation of other loose beads and impeding creative input by the user.
b. The re-stringing device is rigid making the pre-strung beads inflexible and has elements that make the device awkward to use with rigid parts that will block the users view or that will press up against the user's hands getting in the way of the beading process.
c. The re-stringing device is not made for the purpose of incorporating new loose beads into the beading designs, this problem leaves the user to only re-string the beads that are already pre arranged onto the temporary string, therefore not allowing the user to create unique designs and patterns in the beading process.
d. The re-stringing device provides no room for loose beads to be added into the designs, especially larger or odd shaped beads, if loose beads were added to the beading design using this device, the newly incorporated beads would not have any room to go and end up getting in the way of the beading process.
e. The rotating beading device and the mechanical devices only allow the user to string a random collection of beads, the user will not have any way to choose which beads or how many will end up on their string, if they did want to make a pattern they would have to go back and forth to different devices with the different beads to get a patterned result.

BRIEF SUMMARY OF THE INVENTION

Many beads are available at bead stores that can be purchased on temporary strings, also called pre-strung beads. The pre-strung beads are usually cut off of the temporary string and are restrung onto a permanent wire or string manually. The current invention is a bead stringing apparatus that suspends these pre-strung beads by the temporary string in a taut position over an open workspace. Both ends of the temporary string are placed under suspension knobs. The knobs are turned which pulls the temporary string along with the pre-strung beads in a taut position. The knobs are parallel to each other and along with the base they stretch the pre-strung beads in a straight line over an open work space. The pre-strung beads are now aligned and ready to be restrung by a permanent wire directly from the suspended temporary string. The open work space that is all the way around the beads provides ample room for the user to restring the pre-strung beads at any angle without any parts to impede the user from viewing the pre-strung beads and nothing to block the hands from the beading process. After suspending the pre-strung beads in a taut position across the apparatus the user can easily re-string the pre-strung beads onto their permanent wire. To create patterns the user can separate out a selected row of pre-strung beads with a measuring tool. The measuring tool is adjustable to separate the desired amount the user wants to use to create a beading pattern measuring the beads so the user does not have to count them. The user can slide the selected amount of pre-strung beads away from the rest along the taut temporary string. They can now put their wire through the tunnel of aligned pre-strung beads. When the end of the wire exits the row of selected pre-strung beads a pattern of loose beads can be added in. The user can measure out the next row of pre-strung beads to restring along the temporary string. When this next row of pre-strung beads is restrung by the wire the loose beads will be locked in between the rows of pre-strung beads and suspended by the wire. If the user makes a mistake in the beading process, or if the user wants to change something in their beading design, they can just simply pull out the wire and start over without losing much time. If the user liked their beaded design, they will simply loosen the knobs and release the end of the temporary string and pull all of the newly strung beads, pre-strung and loose beads included, onto the wire alone. The temporary string can be pulled out and discarded. Accordingly, several objects and advantages of the present invention are:

a. To provide a bead stringing apparatus that enables the user to quickly re-string pre-strung beads and lets the user incorporate new loose beads for endless beading patterns and original beading designs.
b. To provide a bead stringing apparatus that eliminates unnecessary rigid parts that impede the beading process such as the planar surface of U.S. Pat. No. 3,545,069. The beading apparatus of the current invention suspends the pre-strung beads over an open work space that is provided above, below, and around the entire string of pre-strung beads, making the beads and working area very flexible so the user can bead at any angle without obstructing elements.
c. To provide a bead stringing apparatus that has enables the user to add infinite amounts of loose beads of any size, shape, or color in and between the pre-strung beads to create their own endless patterns and unique designs which is the desired result by most artists who create beadwork and jewelry.
d. To provide a bead stringing that has ample room for the user to incorporate loose beads into their work. The result is that these beads will hang down below the pre-strung beads onto the permanent wire into the open work space out of the way of the beading process.
e. To provide a bead stringing apparatus that allows the user to choose which beads and the number of beads that will go onto their permanent wire. The result is that the user will choose the design patterns they desire, not the machine.
f. To provide a bead stringing apparatus that gives the user the option to start over after seeing their beadwork by working off of the temporary string. If a mistake is made the user will simply pull out the permanent wire and let the loose beads fall away leaving the pre-strung beads still on the temporary string for later use, therefore saving lots of time and lost beadwork.

REFERENCE NUMERALS USED IN DRAWINGS

Figure 1:
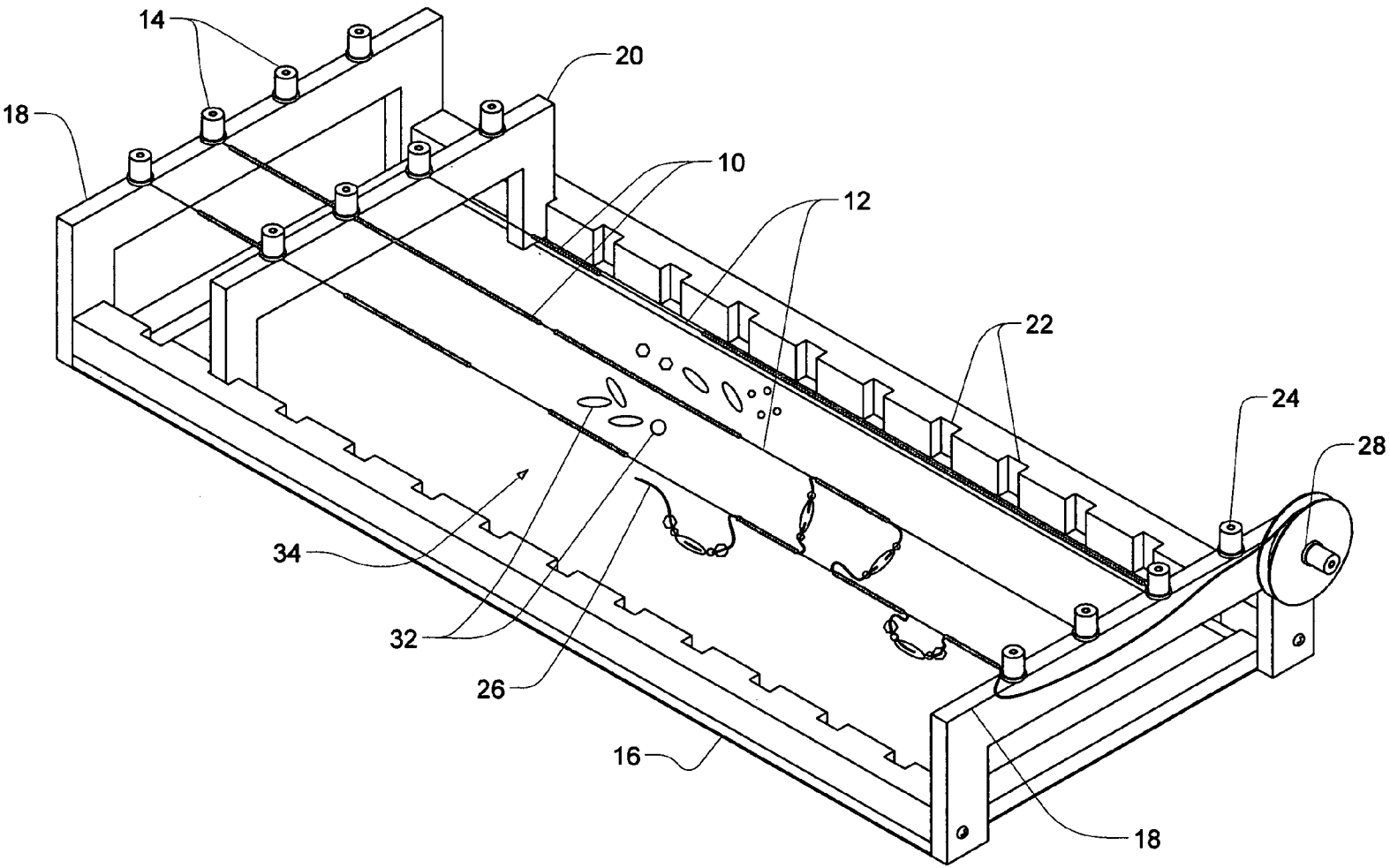
FIG. 1 is a perspective view of the Bead Stringing Apparatus for Faster Beading of Original Designs in it working form with an original beaded pattern and design being created.

10. pre-strung beads
12. temporary string
14. knobs
16. base
18. stretcher bar
20. adjustable stretcher bar
22. slot
24. screw
26. wire
28. wire holder
30. wire spool
32. loose beads
34. open work space
36. user's hands
38. measuring tool

DETAILED DESCRIPTION OF THE INVENTION

The invention in the preferred embodiment described below consists of a base 16, two stretcher bars 18 and a plurality of knobs located 14 along the top of the stretcher bars 18. The base 16 holds the two stretcher bars 18 parallel to each other. The base 16 in this particular embodiment also acts as a tray to hold beading supplies. The stretcher bars 18 have a plurality of knobs 14 along the top edge attached with screws 24. The knobs 14 are directly parallel to each other on both sides of the base 16 on the top edge of the stretcher bars 18. The pre-strung beads 10 are stretched across the apparatus by the ends of their temporary strings 12 and are held down by the knobs 14 attached to the stretcher bars 18 and held in a taut position in a straight line. Loose beads 32 are also shown on the base 16 to be used and added into the beading designs. The knobs 14 used in the preferred embodiment are made with rubber and held onto the stretcher bars 18 by screws 24. The knobs 14 are female threaded to be held down to the stretcher bar 18 by male threaded screws 24. An adjustable stretcher bar 20 is also provided for the shorter strands of pre-strung beads 10. There are a number of slots 22 along the base 16 to facilitate the adjustable stretcher bar 20. The adjustable stretcher bar 20 slides down into the slots 22 and becomes the new stretcher bar 18 for the shorter strands of pre-strung beads 10. These slots along with the adjustable stretcher bar 20 accommodate the many different lengths that the pre-strung beads 10 are available in at bead shops. There is a wire holder 28 that is created using a screw 24 and a knob 14 that holds the wire spool 30 on the side of the stretcher bar 18 on the outside of the apparatus and keeps the wire spool 30 out of the way during use. The wire holder 28 can be used on either side of the apparatus adjusting to left or right hand users. We found that in experimenting with many different types of knobs 14 and various fasteners, we found that rubber knobs 14 worked the best for keeping the row of pre-strung beads 10 in a taut position without breaking the temporary string 12 when tightened because of the give and take nature of rubber material. The rubber material on the knobs 14 also kept the temporary string 12 from slipping off of the stretcher bar 18. We also found that the female threaded knobs 14 worked best without breaking the temporary string 12 because it worked along with gravity to pull the knob 14 down onto the stretcher bar 18 attached to a male threaded screw 24. Wood is also the material that we used for the stretcher bar 18, we found that it also worked best for keeping the temporary string 12 in taut position without slippage. Other fasteners can be used however we chose these particular elements for the preferred embodiment because they worked the best as a result of much experimentation.

DETAILED DESCRIPTION OF THE DRAWINGS

Shown in FIG. 1 is the bead stringing apparatus in its working position suspending multiple strands of pre-strung beads 10 by their temporary string 12 over an open work space 34. Both ends of the temporary strings 12 of the pre-strung beads 10 are under the knobs 14 which are parallel to each other along the stretcher bars 18. The knobs 14 are stretching the pre-strung beads 10 in a straight line across the apparatus by pulling the temporary string 12 in a taut position. The adjustable stretcher bar 20 is also shown holding one end on the third row of pre-strung beads 10 by the temporary string 12. The first two rows of pre-strung beads 10 show a pattern that has been created with loose beads 32 incorporated in and between the pre-strung beads 10 strung by and held on by the permanent wire 26 creating a beaded design. Infinite beaded patterns can be created with the desired results of the user. The incorporated loose beads 32 are seen hanging down onto the permanent wire 26 below the pre-strung beads 10 out of the way of the user and into the open work space 34. There are other loose beads 32 scattered on the base 16 unstrung and are ready to be incorporated into the beading design. The last formation of loose beads 32 that are on the permanent wire 26 shows the end of the wire 26 ready to be reinserted back into the row of pre-strung beads 10 for more. The adjustable stretcher bar 20 is shown in place inserted into a set of parallel slots 22 along the side of the base 16. The adjustable stretcher bar 20 is also shown being utilized to suspend a shorter row of pre-strung beads 10 by the knobs 14 on the third row of pre-strung beads 10. The wire holder 28 is shown on the right side of the apparatus giving the wire 26 enough tether to facilitate the beading process. Also shown in FIG. 1 is a screw 24 that is on the stretcher bar 18 to hold down the knobs 14.

Figure 2:
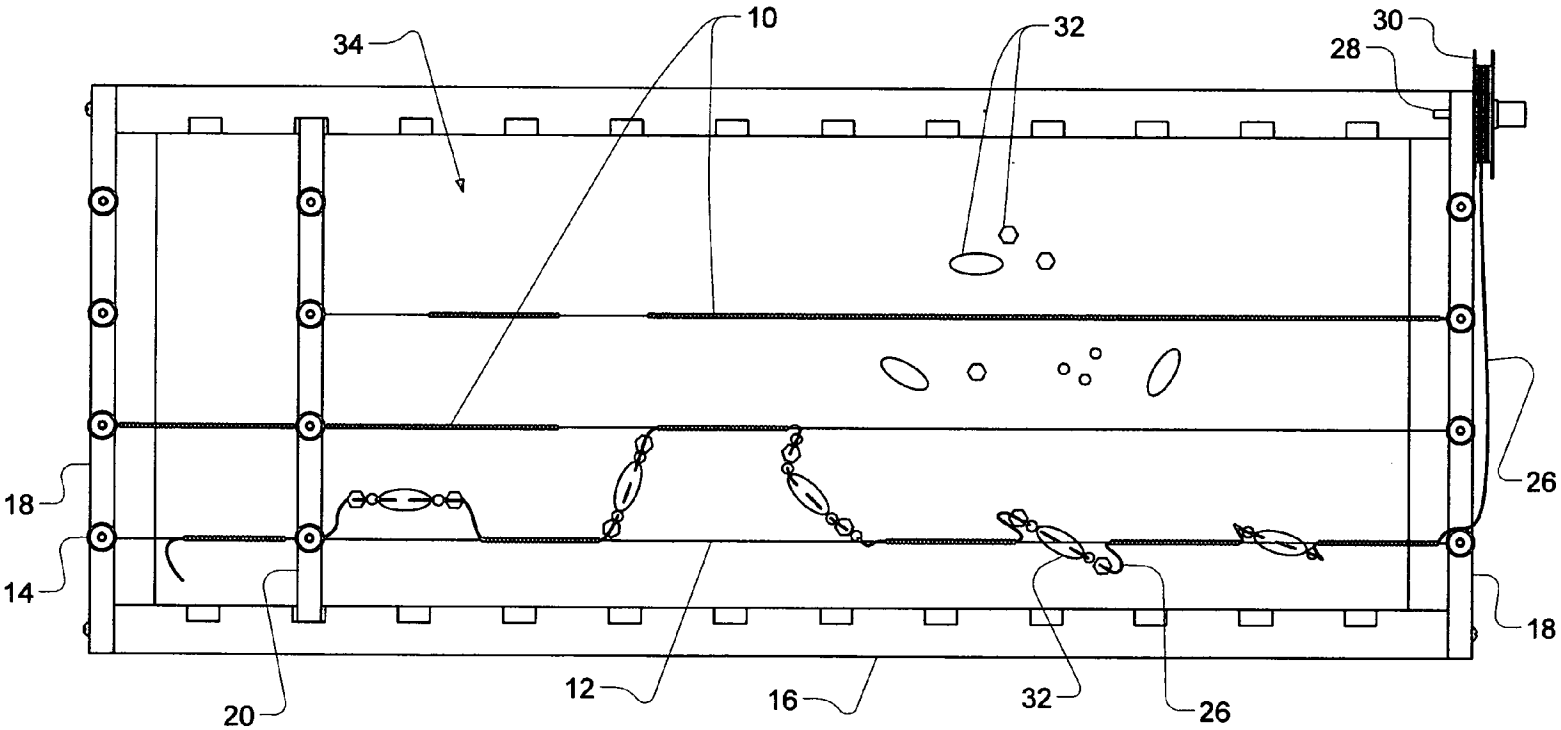
FIG. 2 is a top view of the Bead Stringing Apparatus for Faster Beading of Original Designs in its working form with an original bead design being created and suspended along the temporary string.

Shown in FIG. 2 is the top view of the beading stringing apparatus with three rows of pre-strung beads 10 that are suspended by the parallel knobs 14 by the temporary strings 12. The adjustable stretcher bar 20 is also shown holding one end of the last row of pre-strung beads 10 by the knob 14. There is a beaded formation along the first two rows of pre-strung beads 10 in the process of being created with the permanent wire 26 that has been inserted through the rows of pre-strung beads10 and loose beads 32 are added in altogether creating an original beaded pattern and design. It also shows the same wire 26 going through another section of pre-strung beads 10 in the second row showing how the user can go in and out of the different strands of pre-strung beads 10 for various patterns. This also shows a plain view of the open work space 34 above and below the beads to give the user a clear view of their beadwork. This also shows how the apparatus can hold many colors and many types of pre-strung beads 10 for creating infinite patterns and beading designs. The user can go in and out of the different pre-strung beads 10 providing the user with choices for endless creativity. The wire holder 28 is holding the wire spool 30 to the side of the apparatus out of the way and is providing a convenient place for the wire 26. The loose beads 32 are incorporated in and between the pre-strung beads 10 and into the beaded design held on by the permanent wire that is going through the rows of pre-strung beads and through the loose beads. There are some loose beads 32 available down below on the base 16 available to be incorporated into the beadwork.

Figure 3:
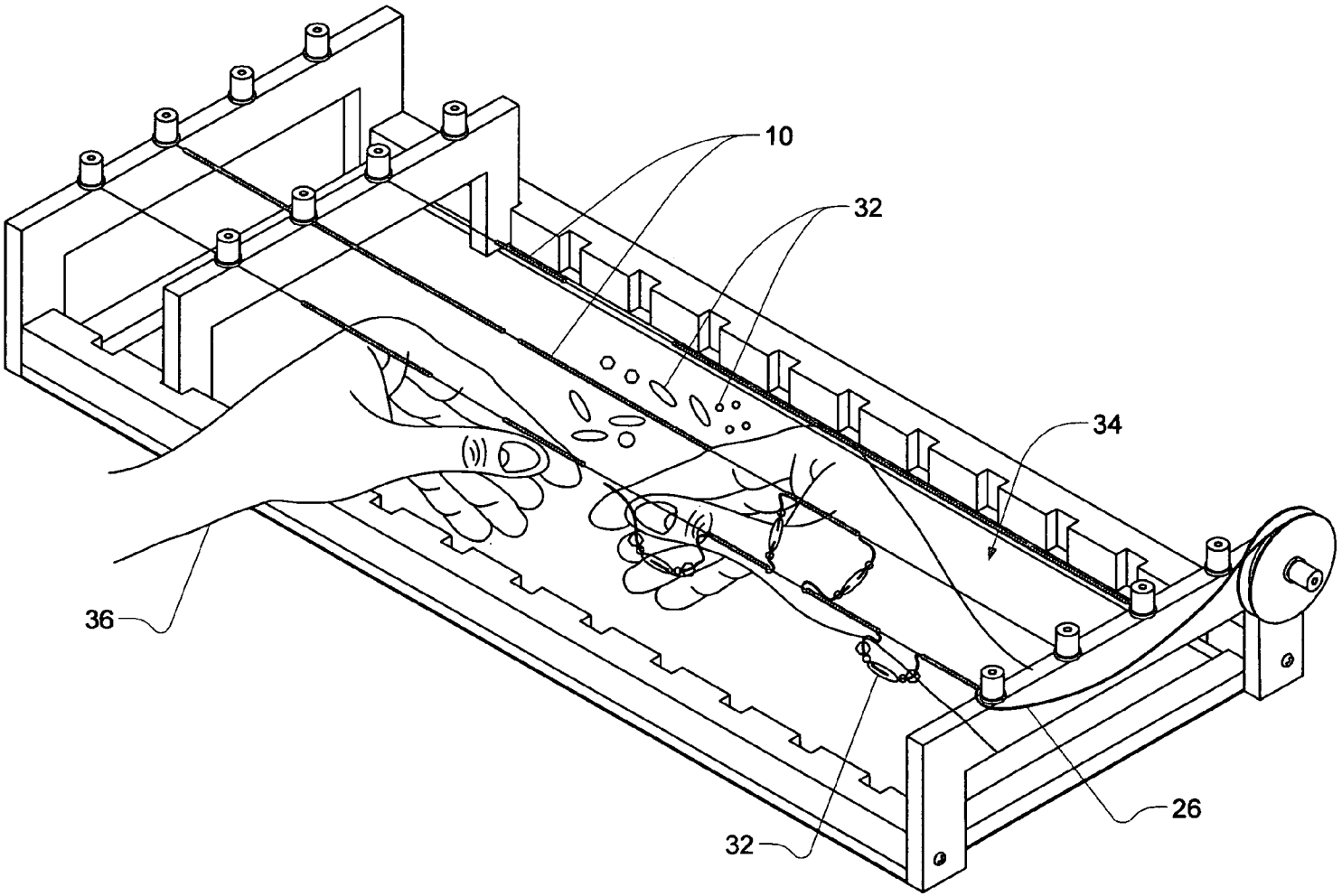
FIG. 3 is a perspective of the Bead Stringing Apparatus for Faster Beading of Original Designs in it working form with the user's hands showing how it is used.
Figure 4:
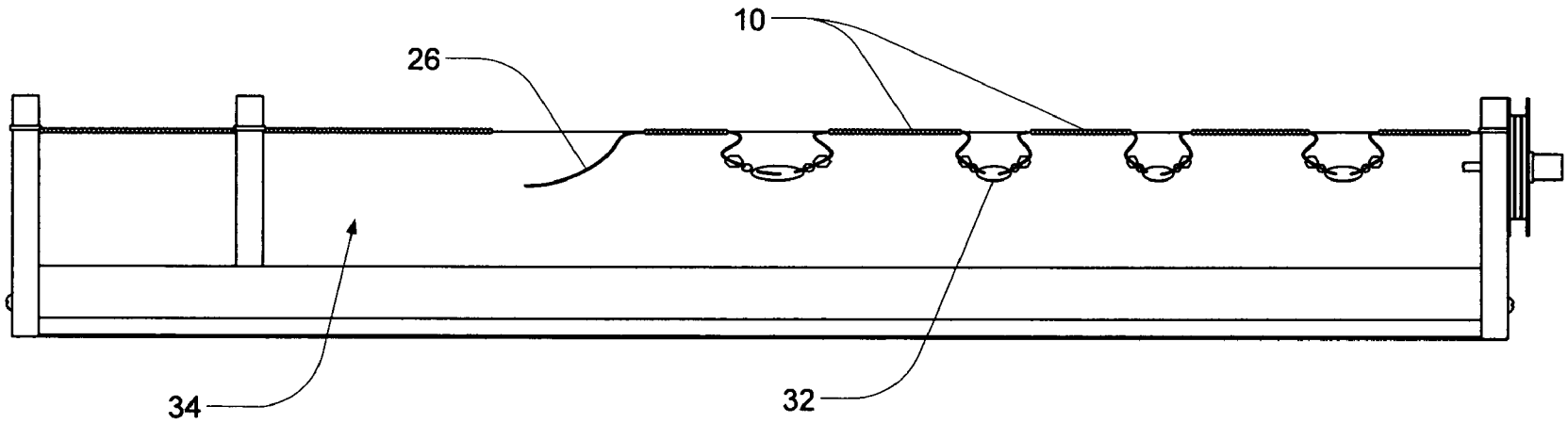
FIG. 4 is a side view of the Bead Stringing Apparatus for Faster Beading of Original Designs in its working form clearly showing the open work space.
Figure 5:
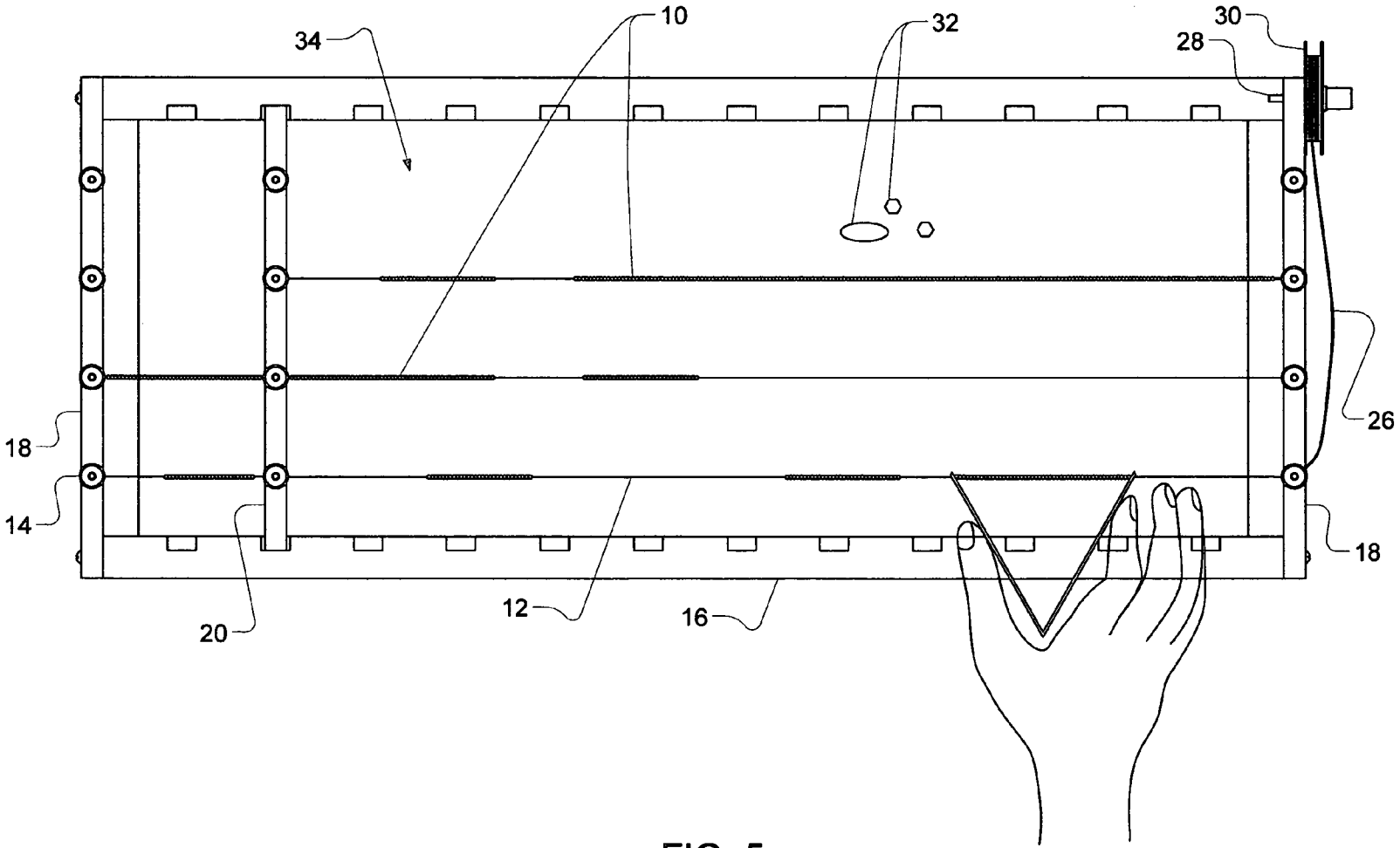
FIG. 5 is a top view of the Bead Stringing Apparatus for Faster Beading of Original Designs in its working form with the user working with the bead measuring tool.

Shown in FIG. 3 is the bead stringing apparatus that is being utilized showing the users hands 36. The user's hands 36 are showing how the beading process takes place with the user's fingers holding the desired amount of pre-strung beads 10 in a selected row to be put onto their wire 26. A formation of beadwork that the user has created along the first and second row of pre-strung beads 10 is in clear view. With the pre-strung beads 10 and the loose beads 32 being incorporated into one beaded design and held by the permanent wire 26. The user has just put a pattern of loose beads 32 onto their wire 26 and is getting ready to put the wire 26 through another selected row of pre-strung beads 10. Also shown is the amount of room provided by the open work space 34 so the users hands 36 are free to move and work without being impeded by any parts on the beading apparatus. The open work space 34 also provides lots of room for newly incorporated loose beads 32 to hang out of the way of the beading process on the wire 26. Shown In FIG. 4 is a side view of the bead stringing apparatus clearly showing the open work space 34 above and below the pre-strung beads 10 and the newly incorporated loose beads 32. The open work space 34 is accommodating the newly incorporated loose beads 32 to hang down below the pre-strung beads 10 onto the wire 26 out of the way of the beading process. Shown In FIG. 5 is a top view of the bead stringing apparatus with a measuring tool 38 that is used to measure the exact amount and length of the pre-strung beads 10 desired by the user to re-string onto their wire 26. The measuring tool 38 is used to separate the pre-strung beads 10 along the temporary string 12 for restringing the exact amount of beads that the user desires. This eliminates the need to count beads for a pattern or design, The bead measuring tool 38 can be adjusted to any size and allows the user to keep measuring the same amount of beads every time for creating their original patterns and designs.

For illustrative purposes we will refer to the stringing material as the wire 26, although a needle and string can also be used in the beading process. The pre-strung beads 10 are suspended across the two parallel stretcher bars 18 by wrapping both ends of the temporary string 12 that holds the pre-strung beads 10 under rubber knobs 14 attached by the screws 24. The user accomplishes this by wrapping one end of the temporary string 12 of the pre-strung beads 10 under a rubber knob 14 and the other end of the same temporary string wrapped under the other knob across from the first and across the on the stretcher bar across from the first knob 14. The knob 14 is then screwed down to the stretcher bar 18 clamping both ends of the temporary strings 12 and suspending the pre-strung beads 10 in a taut position on the temporary string 12 across the open work space 34. The pre-strung beads 10 are in aligned position and are ready to be restrung by the wire 26. On the side of the stretcher bar 18 is a wire holder 28 to hold the wire spool 30 out of the way and at the same time allowing it to spin to provide tether for the wire 26 as it is being used in the beading process. The user will choose the desired amount of pre-strung beads 10 they want to re-string by separating them from the other pre-strung beads 10 along the temporary string 12 using the measuring tool 38. The user will then put the end of their permanent wire through the row of selected pre-strung beads easing them onto their wire 26 using their other hand 36 to support the pre-strung beads 10 from sliding away from the permanent wire 26. Upon exiting the row of pre-strung beads 10 with their wire 26, the user can then incorporate other loose beads 32 onto their wire 26 into their design. The result is that the other newly incorporated loose beads 32 will hang down below the pre-strung beads 10 on the wire 26 out of the way into the open work space 34. The wire 26 can be reinserted back into another row of pre-strung beads 10 for more. This can be repeated to create any pattern with all of the loose beads 32 and pre-strung beads 10 together creating a unique and original design. The open work space 34 below the pre-strung beads 10 provides room and access for the user's hands 36 and allows them to bead them at any angle. It also provides ample room for the newly incorporated loose beads 32 to hang down out of the way of the beading process. The open work space 34 is above the base 16 that acts as a tray to conveniently provide room for the loose beads 32 and any beading tools that the user will need in the beading process keeping the user organized saving time. The adjustable stretcher bar 20 is used when the temporary string 12 holding pre-strung beads 10 is shorter than the stretcher bars 18 that are stationery on the beading apparatus. The adjustable stretcher bar 20 slips into sets of slots 22 that are provided along the base 16. The user will use the slots 22 that are respective to the proper length of the pre-strung beads 10. The apparatus has multiple knobs 14 and the user can have multiple strands of pre-strung beads 10 on the apparatus at the same time so that they can weave in and out of the pre-strung beads 10 choosing various colors and sizes. The user can also incorporate any amount of different loose beads 32 from any source to put onto their wire 26 placing them in and between all of the pre-strung beads 10. The user can have endless creative freedom creating infinite designs and patterns. When a design is created the user can stretch their beadwork out along the temporary string 12 so that they can see if they are satisfied with their design. If the user is not satisfied with their design, they can easily pull out the wire 26 and the loose beads 32 will fall away while all of the pre-strung beads 10 will remain on the temporary string 12 for later use. If the user is satisfied with their design, one end of the temporary string 12 can be pulled out by loosening the respective suspension knobs 14 so the temporary string 12 can be pulled out letting all of the newly strung beads fall onto the wire 26 alone. The user can hold back any unused portion of the pre-strung beads 10 still on the temporary string 12 so that they can be reconnected to the stretcher bar 18 for later use. If the user starts a design and wants to take a break or stop beading for the day, the apparatus keeps the beadwork suspended along the temporary string 12 and will remain exactly as the user left it so they can go back and finish it later. Endless strands of beadwork can be created on the apparatus because the user can keep beading with the same wire 26 until the desired length in achieved. The open work space 34 will provide ample room for the beadwork to be stored while it is being created.

From the descriptions above a number of advantages of my bead stringing apparatus become evident:

(a) It allows the user to quickly re-string the pre-strung beads from the temporary string and add any amount of loose beads in and between the pre-strung beads to create infinite original beading designs and patterns chosen by the user not the machine.

(b) There are no unnecessary rigid parts to get in the way of the user's hands or in the way of viewing the beadwork.

(c) Ample room is provided for the newly incorporated loose beads to hang below the pre-strung beads onto the permanent wire and out of the way of the beading process.

(d) If a mistake is made in the bead stringing process the user can simply pull out the wire and start over without losing much time, the pre-strung beads will remain on the temporary string and the loose beads will fall away for later use. When the user is happy with their design, they will simply release the suspension knobs and pull out the temporary string and slide the newly strung beads all fall together onto the permanent wire.

(e) An adjustable bead measuring tool is also provided with the beading apparatus to quickly separate and measure out a row of pre-strung beads along the taut temporary strung so that the user will not have to count the beads when creating beading patterns.

Although the descriptions above contain many specifics, this invention may be embodied in other forms as long as it accomplishes the same task. Other tools and features can also be added such as a bead counting tool so the user can separate the pre-strung beads and get the same amount of beads every time without counting each bead individually. The knobs could be replaced with different types of connector, for instance a spring loaded clamp could be used to suspend the pre-strung beads. The knobs can also be made out of other types of material as long as it accomplishes the same task of holding the pre-strung bead string in a taut position. The apparatus could have a different shaped base or different type of bar to stretch out the pre-strung beads. The base can be made like an open table to accomplish the same task of providing an open space for the pre-strung beads to be stretched across. The base can be made into a tray to provide a place to keep all the beads and tools organized. Thus the scope of this invention indicated by the appended claims and their legal equivalent, rather than by the examples given.

I claim:

1. A Bead stringing apparatus comprising:

at least one row of pre-strung beads;

at least two connectors suspending a strand of said pre-strung beads by both distal ends of the string of pre-strung beads, wherein the string is kept taut so that the pre-strung beads are aligned along said string in a straight line creating a tunnel through the center of the pre-strung beads so they can easily be restrung by a needle and a second string or a permanent wire to speed up the beading process;

at least two stretcher bars;

a base with the at least two stretcher bars that holds the said connectors in a spaced apart position parallel to each other so that the said connectors can keep the temporary string taut therefore aligning the pre-strung beads in a straight line across the apparatus so that they can easily be re-strung by a permanent wire or string and needle;

said stretcher bars and base, hold the connectors in parallel position creating an open work space below said pre strung beads to create said working space to the user that is above and below said pre-strung beads, said open work space allows the user to bead at any angle, said open workspace also allows room for other loose beads to be added in and between said pre-strung beads and also allows room for the newly incorporated loose beads to hang down below said pre-strung beads onto the permanent wire or said second string out of the way of the beading process, said open workspace also allows the user room to combine loose beads and said pre-strung beads in various patterns and designs into one new strand.

* * * * *